US006568536B2

(12) United States Patent
Tanaka et al.

(10) Patent No.: US 6,568,536 B2
(45) Date of Patent: May 27, 2003

(54) CLASSIFIER AND METHOD FOR PREPARING TONER

(75) Inventors: Tetsuya Tanaka, Kanagawa (JP); Yoshihiro Saitoh, Shizuoka (JP); Eisuke Sugisawa, Shiuoka (JP); Kazuyoshi Morii, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/793,247

(22) Filed: Feb. 26, 2001

(65) Prior Publication Data

US 2002/0021987 A1 Feb. 21, 2002

(30) Foreign Application Priority Data

Feb. 28, 2000 (JP) ..... 2000-050646

(51) Int. Cl.[7] ..... B07B 4/00

(52) U.S. Cl. ..... 209/139.2; 209/143; 209/148; 209/710

(58) Field of Search ..... 209/133, 138, 209/139.1, 139.2, 142, 143, 148, 710, 713, 714

(56) References Cited

U.S. PATENT DOCUMENTS

| | | | | |
|---|---|---|---|---|
| 4,680,107 A | * | 7/1987 | Manola | 209/139.2 |
| 5,165,549 A | * | 11/1992 | Kanda et al. | 209/138 X |
| 5,938,045 A | * | 8/1999 | Makino et al. | 209/143 X |
| 6,269,955 B1 | * | 8/2001 | Morimoto et al. | 209/139.1 X |

FOREIGN PATENT DOCUMENTS

| | | | |
|---|---|---|---|
| SU | 1445761 | * 12/1988 | 209/143 |
| SU | 1488020 | * 6/1989 | 209/143 |

* cited by examiner

*Primary Examiner*—Tuan N. Nguyen
(74) *Attorney, Agent, or Firm*—Cooper & Dunham LLP

(57) ABSTRACT

A classifier is proposed which includes a dispersion chamber for dispersing a powder material therein, a classification chamber connected to the dispersion chamber, and a conical member disposed between the dispersion chamber and the classification chamber, wherein the dispersion chamber includes a particle residence prevention member for preventing the powder material from residing within the dispersion chamber by changing the speed of the cyclonic flow of the powder material in the dispersion chamber so as to be decreased in the direction of the feed inlet within the dispersion chamber, and a method of preparing toner by use of the classifier is also proposed.

20 Claims, 2 Drawing Sheets

CLASSIFIER AND METHOD FOR PREPARING TONER

BACKGROUND OF THE INVENTION

1. Field of the Invention

The present invention relates to a classifier and a method for preparing a toner. More specifically, the present invention relates to a classifier for classifying particles to obtain toner particles with a desired particle diameter in the process of preparing a dry toner, which toner is used to develop latent electrostatic images into visible toner images, particularly in the fields of electrophotography, electrostatic recording, and electrostatic printing.

2. Discussion of Background

A conventional classifier for separating a solid powder material with a particle size in the order of micron into fine particles and coarse particles is composed of a cylindrical dispersion chamber and a classification chamber. A conical member is disposed between the dispersion chamber and the classification chamber. The solid material is fed into the dispersion chamber through a feed inlet formed at an outer upper end portion of the dispersion chamber. The solid material undergoes a dispersion operation in a stream of cyclonic air introduced into the dispersion chamber, and is then introduced into the classification chamber where the solid material is subjected to centrifugal classification, so that the solid material is separated into fine particles and coarse particles, which are then respectively discharged from a fine particle discharge outlet and from a coarse particle discharge outlet.

FIG. 6 is a schematic cross sectional view of a conventional classifier, showing the structure thereof.

The classifier shown in FIG. 6 is composed of a feed pipe 1 for feeding a solid material and a stream of transport air serving as primary transport air stream for transporting the solid material into a dispersion chamber 3; an exhaust pipe 2 for discharging ultrafine particles together with air; the dispersion chamber 3; an air flow-in inlet 4 through which air serving as secondary transport air is to be fed into the dispersion chamber 3 is caused to flow in; a fine particle discharge outlet 5 from which fine particles are discharged together with air; a coarse particle discharge outlet 6 from which coarse particles are discharged together with air; a conical member/disposed at a lower portion of the dispersion chamber 3 for increasing the cyclonic flow of the solid material within the dispersion chamber 3; a classification plate 8 disposed under the conical member 7; and a classification chamber 9 formed so as to be enclosed with the conical member 7 and the classification plate 8. The above-mentioned conventional classifier is provided in its entirely in a substantially cylindrical housing.

The operation of the conventional classifier shown in FIG. 6 will now be explained.

To begin with, air is introduced into the dispersion chamber 3 and the classification chamber 9 from the feed pipe 1 and from the air flow-in inlet 4, and at the same time, the introduced air is discharged from the dispersion chamber 3 and from the classification chamber 9 through the fine particle discharge outlet 5 and the coarse particle discharge outlet 6, whereby a cyclonic air stream is formed within both the dispersion chamber 3 and the classification chamber 9.

With the formation of the cyclonic air stream within the dispersion chamber 3 and the classification chamber 9, a solid material is introduced into the dispersion chamber 3 together with air through the feed pipe 1. In the dispersion chamber 3, the solid material is rotated and caused to fall down while being subjected to centrifugal force by the cyclonic air stream. In the course of the falling down of the centrifuged solid material, ultra-fine particles of the solid material with an extremely small particle size are led toward a central portion of the dispersion chamber 3 and discharged outside through the exhaust pipe 2 which is connected to a suction device such as a suction fan (not shown).

The solid material, while rotating and falling in the dispersion chamber 3, is led into the classification chamber 9 through a ring-shaped slit A. In the classification chamber 9, the solid material again undergoes centrifugation. In the course of the centrifugation, coarse particles of the solid material are moved away from the central portion of the classification chamber 9 by centrifugal force, and are caused to pass through a ring-shaped slit B which is formed between the classification plate 8 and the inner wall of the classification chamber 9, and are finally discharged outside from the coarse particle discharge outlet 6, for example, with the aid of a suction fan (not shown).

On the other hand, fine particles of the solid material are attracted to the central portion of the classification chamber 9 by centripetal force, and are then discharged outside through the fine particle discharge outlet 5 which is connected to a suction device such as a suction fan (not shown).

For use in such a conventional classifier as mentioned above, there is proposed a method of preventing an aggregate from mixing with the solid material which is led into the classification chamber, for instance, in Japanese Laid-Open Patent Application 10-43692. In the Japanese Laid-open Patent Application, there is disclosed a classifier comprising a rotor for producing the cyclonic air stream, which rotor is disposed at an upper portion of the dispersion chamber, thereby preventing the particles of the solid material from aggregating in the dispersion chamber and improving the yield of the product.

The above-mentioned conventional classifier is capable of preventing the aggregation of the particles of the solid material by the provision of the rotor for producing the cyclonic air stream. However, it is not always easy to provide such a rotor.

Furthermore, the conventional classifier has two major problems to be tackled.

One problem is that there must be improved the dispersing performance for the solid material introduced into the dispersion chamber. It will be ideal that the particles of the solid material individually smoothly pass through the dispersion chamber and are then subjected to centrifugal classification in the classification chamber. However, there is a case where the particles interact to form aggregates while the particles descend in the dispersion chamber, and continually stay or reside, whirling, even in an upper portion of the classification chamber. This will bring about a significant reduction in the classification accuracy.

The other problem is that there must be improved the classification accuracy of the classification chamber.

Ideally, the solid particles led into the classification chamber from the dispersion chamber would be classified, for example, in such a manner that the solid particles with a desired particle diameter or more are all collected as coarse particles and the solid particles with a particle diameter less than the desired particle diameter are all collected as fine particles. However, in the conventional classifier, there occurs a problem that part of the particles having the particle diameters larger than the desired particle diameter are collected as the fine particles, while part of the particles having particle diameters smaller than the desired particle diameter are collected as the coarse particles. Therefore, a classifier capable of classifying the particles with a minimum classification inaccuracy and a sharp particle size distribution is in demand.

SUMMARY OF THE INVENTION

It is therefore a first object of the present invention to provide a classifier which is capable of solving the above-mentioned problems in the conventional classifier, improving the particle dispersion performance of the dispersion chamber by structural modification of the classifier, which can be carried out without difficulty, and also improving the classification accuracy in the classification chamber, thereby separating particles with particle diameters within a desired range, with high efficiency.

A second object of the present invention is to provide a method of producing a toner having a desired particle diameter using the above-mentioned classifier.

The first object of the present invention can be achieved by a classifier comprising:

a dispersion chamber for dispersing a powder material therein which is fed thereinto together with a stream of transportation gas through a feel inlet so as to cause a cyclonic flow of the powder material within the dispersion chamber, with finely-divided particles with particle diameters less than a predetermined particle diameter contained in the powder material being separated and discharged therefrom by means of centripetal force, a classification chamber connected to the dispersion chamber so that the powder material fee of the finely-divided particles is fed thereinto from the dispersion chamber, which classification chamber is capable of classifying the power material free of the finely-divided particles into fine particles and coarse particles by means of centrifugal force, and a conical member disposed between the dispersion chamber and the classification chamber which is capable of serving as a partition therebetween and enhancing the cyclonic flow of the powder material within the dispersion chamber, wherein the dispersion chamber comprises particle residence prevention means for preventing the powder material from residing within the dispersion chamber by changing the speed of the cyclonic flow of the powder material in the dispersion chamber so as to be decreased in the direction of the feed inlet within the dispersion chamber.

In the above-mentioned classifier, the particle residence prevention means may comprise a cylindrical chamber which constitutes an upper part of the dispersion chamber, with the upper base portion of the cylindrical chamber being made smaller in size than the lower base portion thereof, and the feed inlet being disposed at the smaller upper base portion of the chamber.

In the above-mentioned classifier, the cylindrical chamber of the particle residence prevention means may also be in the shape of a circular truncated cone having such a side wall that is inclined at an angle of $\alpha$ with respect to a horizontal direction of the base portion of the chamber, where $0°<\alpha<90°$, or the cylindrical chamber of the particle residence prevention means may have a curved side wall, whereby the dispersion performance for the powder material attained by the dispersion chamber, and the classification accuracy for the powder material attained by the classification chamber can be improved.

In the above-mentioned classifier, it is preferable that the angle $\alpha$ be in a range of $30°\leqq\alpha<90°$, since the particle residence prevention effect of the particle residence prevention means can be improved by setting the angle $\alpha$ in the range.

In the above-mentioned classifier, it is preferable that the particle residence prevention means be constructed so as to be detachable from the dispersion chamber. This is because the conditions for the classification, such as the above-mentioned angle $\alpha$, can be changed, and the time required for changing the conditions for the classification can be shortened.

The above-mentioned classifier may comprise a plurality of feed inlets for feeding the powder material into the dispersion chamber by providing at least one additional feed inlet in addition to the feed inlet, whereby the powder material can be subdivided and fed so as to reduce the interaction of the particles of the powder material and accordingly the dispersion performance of the dispersion chamber and the classification accuracy of the classification chamber can be improved.

In the above-mentioned classifier, it is preferable that the conical member further comprise at least one ring-shaped member with a predetermined diameter and a predetermined thickness at a lower portion or the conical member. This is because by the provision of the ring-shaped member at the lower portion of the conical member, the flow of the powder material under the conical member can be changed in such a manner that the speed of the flow toward the center of the conical member is made greater than that in the other directions, whereby the introduction of the powder material to the central portion of the classification chamber can be facilitated and the deterioration of the classification performance of the classification chamber can be reduced.

When a plurality of the ring-shaped members is provided, the above-mentioned effect of reducing the deterioration of the classification performance of the classification chamber can be further increased.

In the above-mentioned classifier, it is preferable that at least one of the diameter or the thickness of the ring-shaped member be made changeable in accordance with the classification conditions. This is because when the diameter or the thickness of the ring shaped member is made changeable in accordance with the classification conditions, the yield of a desired product can be increased easily.

Furthermore, it is preferable that the ring-shaped member be made detachable from the conical member. This is because when the ring shaped member is made so as to be detachable from the conical member, the replacement of the ring-shaped member with a ring-shaped member with a different thickness or height can be carried out without difficulty in accordance with the desired classification performance, and the time required for the replacement can be shortened.

The second object of the present invention can be achieved by a method of producing toner for developing a latent electrostatic image to a visible toner image for use in electrophotographic image formation apparatus, wherein a toner with a predetermined particle diameter range is produced, including the step of classifying a pulverized solid material by use of the above-mentioned classifier of the present invention.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

The classifier of the present invention comprises:

a dispersion chamber for dispersing a powder material therein which is fed thereinto together with a stream of transportation gas through a feed inlet so as to cause a cyclonic flow of the powder material within the dispersion chamber, with finely-divided particles with particle diameters less than a predetermined particle diameter contained in the powder material being separated and discharged therefrom by means of centripetal force, a classification chamber connected to the dispersion chamber so that the powder material free of the finely-divided particles is fed thereinto from the dispersion chamber, which classification chamber is capable of classifying the power material free of the finely-divided particles into fine particles and coarse particles by means of centrifugal force, and a conical member disposed between the dispersion chamber and the classification chamber, which is capable of serving as a partition therebetween and enhancing the cyclonic flow of the powder material within the dispersion chamber, wherein the dispersion chamber comprises particle residence prevention means for preventing the powder material from residing within the dispersion chamber by changing the speed of the cyclonic flow of the powder material in the dispersion chamber so as to be decreased in the direction of the feed inlet within the dispersion chamber.

Other features of this invention will become apparent in the course of the following description of exemplary embodiments, which are given for illustration of the invention and are not intended to be limiting thereof.

Figure 1:
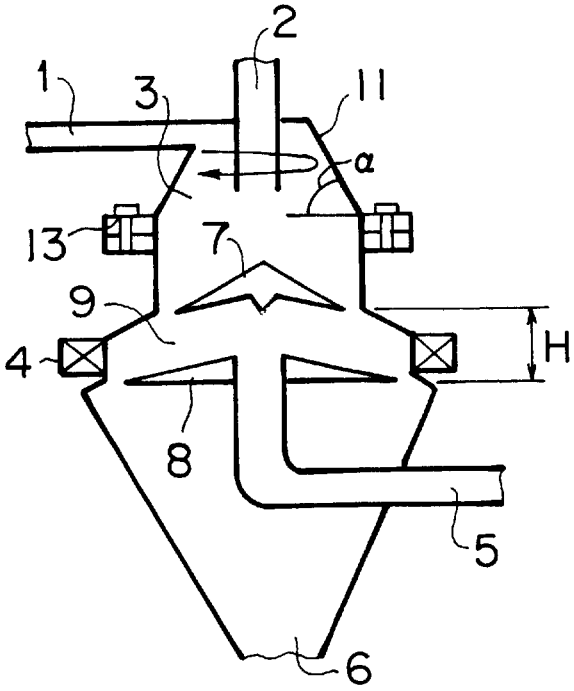
FIG. 1 is a schematic cross sectional view of a classifier according to the present invention.

FIG. 1 is a schematic cross-sectional view of an example of a classifier of the present invention, showing the structure of the classifier. In FIG. 1, the same reference numerals as used in FIG. 6 designate identical or corresponding parts.

Figure 6:
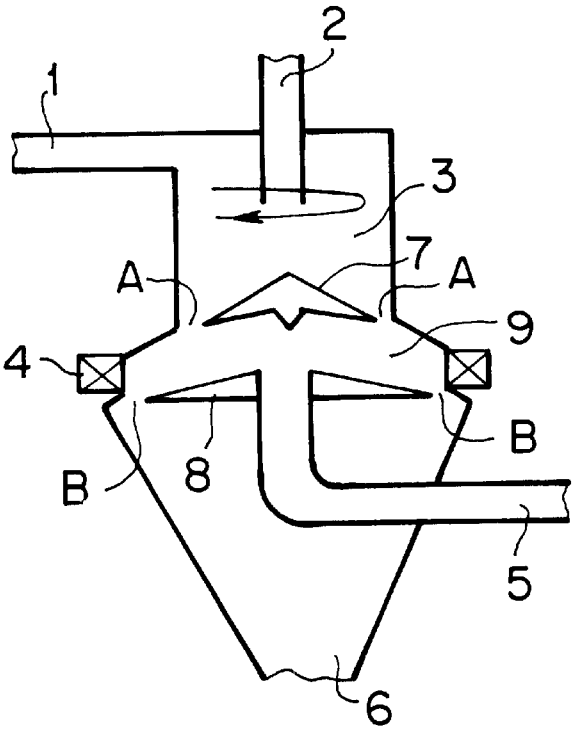
FIG. 6 PRIOR ART
FIG. 6 is a schematic cross sectional view of a conventional classifier.

The classifier shown in FIG. 1 is provided with particle residence prevention means 11 for preventing the solid material from aggregating in an upper portion of the dispersion chamber 3. The classifier shown in FIG. 6 is not provided with such particle residence prevention means 11 as shown in FIG. 1.

In the dispersion chamber 3 of the classifier shown in FIG. 1, as shown in the figure, the inside wall of the upper portion of the dispersion chamber 3 is tapered to the top of the upper portion in the vicinity of which there is disposed the feed pipe 1 through which the solid material is transported into the dispersion chamber 3 by a stream of transportation air. In other words, the inside wall of the upper portion or the dispersion chamber 3 is made gradually narrower toward to the top of the upper portion thereof.

Thus, the particle residence prevention means 11 comprises a cylindrical chamber which constitutes an upper part of the dispersion chamber 3, with the upper base portion of the cylindrical chamber being made smaller in size than the lower base portion thereof, and the feed inlet of the feed pipe 1 being disposed at the smaller upper base portion of the chamber, in the shape of a circular truncated cone having such a side wall that is inclined at an angle of $\alpha$ with respect to a horizontal direction of the base portion of the chamber, where $0°<\alpha<90°$, preferably $30°\leqq\alpha<90°$ for effectively preventing the aggregation of the particles of the solid material, as shown in FIG. 1.

In the thus constructed particle residence prevention means 11, the cyclonic rotating radius of the particles of the solid material is made smaller toward the feed inlet of the feed pipe 1, so that the particles of the solid material fed into the dispersion chamber 3 are caused to descend while whirling and led into the classification chamber 9.

By the provision of the particle residence prevention means 11, which is in the shape of the circular truncated cone, in the upper portion of the dispersion chamber 3, it is made difficult for the particles of the solid material to reside near the feed inlet of the feed pipe 1 because the upper base portion of the chamber is smaller in size than the lower base portion, so that the particles are made difficult to aggregate while the particles of the solid material are descending.

With reference to FIG. 1, the cross section of the inside wall of the particle residence prevention means 11 is linearly inclined. However, the cross section of the inside wall of the particle residence prevention means 11 is not necessarily limited to such a linear shape, but may be in a curved shape, either curved inwards or outwards.

Instead of the single feed pipe 1 as mentioned above, a plurality of feed pipes can also be provided, whereby even when a predetermined mount of the particles is fed, the particles can be fed in a subdivided manner, whereby the particles of the solid material can be prevented from interacting and aggregating.

Figure 7:
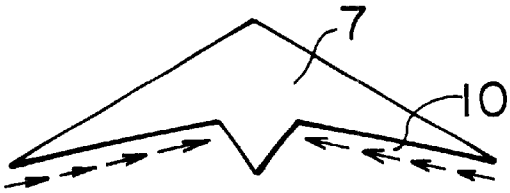
FIG. 7 is a schematic cross sectional view of a conical member in explanation of the flow of air along the lower wall thereof.

Under the conical member 7, there is the flow of air as indicated by the arrows shown in FIG. 7. More specifically, the speed of the flow of air near the lower wall of the conical member 7 is greater than that of the flow of air in other areas so that the solid material tends to be attracted to the central portion of the lower wall of the conical member 7 and is apt to be then introduced into the central portion of the classification chamber 9.

Figure 2:
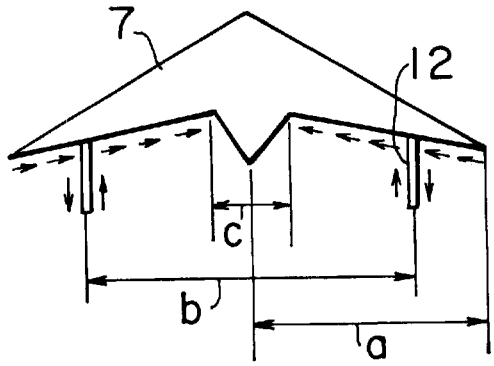
FIG. 2 is a schematic cross sectional view of an example of a conical member for use in the classifier illustrated in FIG. 1, showing the structure thereof.

In order to prevent this, it is preferable to provide a ring-shaped member 12 at a lower portion of the conical member 7 as shown in FIG. 2. By the provision of the ring-shaped member 12, the flow of air along the lower wall of the conical member 7 can be adjusted in such a manner that coarse particles to be collected on a coarse particle collecting side are collected on the coarse particle collecting side, without being collected on a fine particle collecting side, whereby the classification accuracy of the classification chamber 6 can be significantly improved.

As the ring-shaped member 12, any ring-shaped member can be employed. However, it is preferable that the ring-shaped member 12 be in the shape of a true roundness, free of deviation from roundness.

Figure 3:
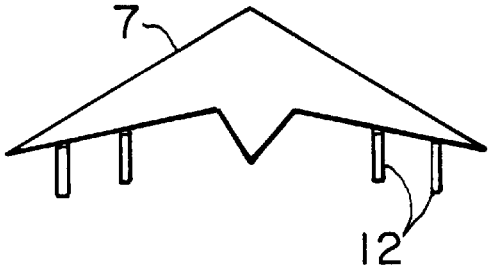
FIG. 3 is a schematic cross sectional view of another example of the conical member for use in the classifier of the present invention, showing the structure thereof.

As shown in FIG. 3, there can be provided a plurality of ring-shaped members 12 at the lower wall of the conical member 7, whereby the flow of air along the lower wall of the conical member 7 can be further changed and accordingly the classification accuracy of the classification chamber 6 can be further improved, with improvement in the effect of preventing the particles to be collected on the coarse particle collecting side from being collected on the fine particle collecting side.

Figure 4:
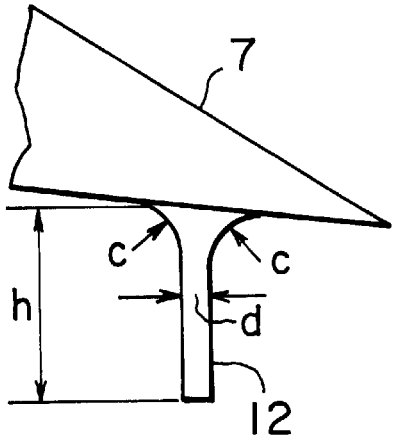
FIG. 4 is a partially sectional view of an improved ring-shaped member for use in the classifier of the present invention.

As shown in FIG. 4, it is also preferable that the height (h) of the ring-shaped member 12 be ½ the height (H) of the classification chamber 9, which height (H) is shown in FIG. 1, in order that the flow of air within the classification chamber 9 may not be changed drastically and the yield of the product cannot be decreased. When the ring-shaped member 12 is excessively high, the flow of air within the classification chamber 9 will be changed drastically and the yield of the product can be decreased. The height (h) of the ring-shaped member 12 can be changed in accordance with the classification conditions.

Furthermore, as shown in FIG. 4, it is also preferable that the thickness (d) of the ring-shaped member 12 be 30% or less of the lower radius (a) of the ring-shaped member 7, which lower radium (a) is shown in FIG. 2, in order that the flow of air within the classification chamber 9 may not be changed drastically and the yield of the product cannot be decreased. When the ring-shaped member 12 is excessively thick, the flow of air within the classification chamber 9 will be changed drastically and the yield of the product can be decreased. The thickness (d) of the ring-shaped member 12 can be changed in accordance with the classification conditions.

Furthermore, as shown in FIG. 2, it is preferable that the diameter (b) of the ring shaped member 12 be set so as to be greater than the diameter (c) of a lower convex portion of the conical member 7. This is because even when the diameter (b) of the ring-shaped member 12 is set so as to be smaller than the diameter (c) of a lower convex portion of the conical member 7, the flow of air along the lower wall of the conical member 7 is not substantially changed and accordingly the movement of the solid material is not substantially changed, either. The result is that their cannot be obtained the effect of preventing the particles to be collected on the fine particle collecting side from being collected the coarse particle collecting side.

Furthermore, as shown in FIG. 4, it is also preferable that the inside and/or outside of the bottom portion of the ring-shaped member 12 jointed to the lower wall of the conical member 7 be curved as indicated by the arrow C. This is because the curved inside and/or outside of the bottom portion of the ring-shaped member 12 is capable of preventing the occurrence of the problems that the solid material accumulates at the bottom portion in the course of the continuous operation of the classifier, and the accumulation lowers the yield of the product and makes it difficult to clean the ring-shaped member 12.

It is also preferable that the particle residence prevention means 11 shown in FIG. 1 be constructed so as to be detachable from the dispersion chamber 3 by use of detachment means 13 as shown in FIG. 1. This is because the particle residence prevention means 11 can be attached to the dispersion chamber 3 without difficulty, and the conditions for the classification, such as the above-mentioned angle α, can be changed without difficulty, and the time required for changing the conditions for the classification with replacement of the particle residence prevention means 11 can be shortened.

Figure 5:
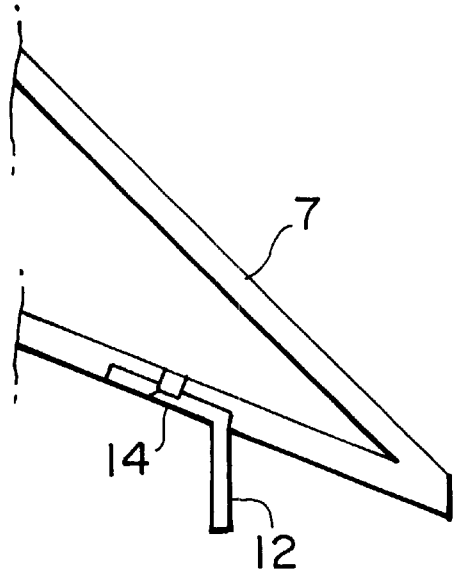
FIG. 5 is a partially sectional view of another improved ring-shaped member for use in the classifier of the present invention.

It is also preferable that the ring-shaped member 12 shown in FIGS. 2 to 4 be detachable from the conical member 7. The ring-shaped member 12 can be made detachable from the conical member 7 by use of a detachment mechanism 14 as shown in FIG. 5. More specifically, the ring shaped member 12 can be detachably screwed to the conical member 7. By making the ring-shaped member 12 is made detachable from the conical member 7, the height of the ring-shaped member 7 can be easily adjusted, and the time required for the replacement of the ring-shaped member 12 can be shortened.

[Preparation of Solid Material]

A mixture of 85 parts by weight of styrene—acrylic copolymer resin and 15 parts by weight of carbon black was fused and kneaded, and thereafter cooled.

The cooled solid material was crushed in a hammer mill, and thereafter pulverized in a jet mill, thereby preparing a solid material.

The thus obtained solid material was subjected to classification using classifiers as shown below.

EXAMPLE 1

A classifier as shown in FIG. 1 was used, in which a residence prevention means 11 in the shape of a circular truncated cone having such a side wall that was inclined at an angle of α, where α=45°, was set on the top of a dispersion chamber 3, with the provision of a feed inlet on an upper portion of the residence prevention means which was connected to a feed pipe 1 for feeding a solid material into the classifier.

With an exhaust blower pressure set at 1620 mmAq, the solid material with the above-mentioned composition was fed into the classifier at a speed rate of 10.5 kg/h and classified so as to obtain particles with a volume mean diameter of 7.8 μm when measured by the Coulter counter method.

The result was that the volume mean diameter obtained was 7.66 μm, the content of fine particles with a particle diameter of 4 μm or less was 8.67 wt. %, and the content of coarse particles with a particle diameter of 12.7 μm or more was 2.31 wt. %.

The particle size distribution obtained in this example was sharper in comparison with the particle size distribution obtained in Comparative Example described later.

EXAMPLE 2

The same solid material as used for classification in Example 1 was classified under the same conditions as in Example 1 except that the classifier used in Example 1 was modified so as to increase the number of feeding pipes 1 to two.

The result was that the volume mean diameter obtained was 7.70 μm, the content of fine particles with a particle diameter or 4 μm or less was 7.59 wt. %, and the content of coarse particles with a particle diameter of 12.7 μm or more was 4.21 wt. %.

The particle size distribution obtained in this example was sharper in comparison with the particle size distribution obtained in Comparative Example described later.

EXAMPLE 3

The same solid material as used for classification in Example 1 was classified under the same conditions as in Example 1 except that the classifier used in Example 1 was modified in such a manner that a ring-shaped member 12 as shown in FIG. 2 was provided on the lower side of the conical member 7, which ring-shaped member 12 had a height (h) of about 1/20 the height (H) of the classification chamber 9 (refer to FIG. 1), a thickness (d) of 1.5 mm, and a diameter (b) of 170 mm.

The result was that the volume mean diameter obtained was 7.66 μm, the content of fine particles with a particle diameter of 4 μm or less was 6.67 wt. %, and the content of coarse particles with a particle diameter of 12.7 μm or more was 2.31 wt %.

The particle size distribution obtained in this example was sharper in comparison with the particle size distribution obtained in Comparative Example described later.

EXAMPLE 4

The same solid material as used for classification in Example 1 was classified under the same conditions as in Example 3 except that the classifier used in Example 3 was modified in such a manner that two ring shaped members 12 as shown in FIG. 3 were provided on the lower side of the conical member 7. One of the ring-shaped members 12 was the same as used in Example 3, and the other had a height (h) of about 1/20 the height (H) of the classification chamber 9, a thickness (d) of 1.5 mm, and a diameter (b) of 150 mm. The ring-shaped member 12 with the diameter (b) of 150 mm was disposed inside the ring-shaped member 12 with the diameter (b) of 170 mm as shown in FIG. 3.

The result was that the volume mean diameter obtained was 7.70 μm, the content of fine particles with a particle diameter of 4 μm or less was 6.29 wt. %, and the content of coarse particles with a particle diameter of 12.7 μm or more was 4.21 wt. %.

The particle size distribution obtained in this example was sharper in comparison with the particle size distribution obtained in Comparative Example described later.

EXAMPLE 5

The same solid material as used for classification in Example 1 was classified under the same conditions as in Example 1 except that the classifier used in Example 3 was modified in such a manner that the outside of the bottom portion of the ring-shaped member 12 jointed to the lower wall of the conical member 7 was curved as indicated by the arrow C as shown in FIG. 4.

The result was that the amount of the solid material deposited at the bottom portion of the ring-shaped member 12 was decreased and therefore the ring-shaped member 12 was easy to clean.

EXAMPLE 6

The same solid material as used for classification in Example 1 was classified under the same conditions as in Example 1 except that the classifier used in Example 3 was modified in such a manner that the inside of the bottom portion of the ring-shaped member 12 jointed to the lower wall of the conical member 7 was curved as indicated by the arrow C as shown in FIG. 4.

The result was that the amount of the solid material deposited at the bottom portion of the ring-shaped member 12 was decreased and therefore the ring-shaped member 12 was easy to clean.

EXAMPLE 7

The same solid material as used for classification in Example 1 was classified under the same conditions as in Example 1 except that the classifier used in Example 3 was modified in such a manner that the particle residence prevention means 11 was made detachable from the dispersion chamber 3 by use of the detachment means 13 as shown in FIG. 1.

After the classification, the particle residence prevention means 11 was detached from the dispersion chamber 3 and cleaned. The time required for cleaning the particle residence prevention means 11 was reduced by about 10% in comparison with the classifier shown in FIG. 1, in which the particle residence prevention means 11 was not detachable from the dispersion chamber 3.

EXAMPLE 8

The same solid material as used for classification in Example 1 was classified under the same conditions as in Example 1 except that the classifier used in Example 3 was modified in such a manner that the ring-shaped member 12 was made detachable from the conical member 7.

After the classification, the ring shaped member 12 was detached from the conical member 7 and cleaned. The time required for cleaning the ring-shaped member 12 was reduced by about 15% in comparison with the classifier as used in Example 3, in which the ring-shaped member 12 was not detachable from the conical member 7.

COMPARATIVE EXAMPLES

The same solid material as used for classification in Example 1 was classified under the same conditions as in Example 1 except that the classifier used in Example 1 was replaced by the conventional classifier as shown in FIG. 6.

The result was that the volume mean diameter obtained was 7.88 μm, the content of fine particles with a particle diameter of 4 μm or less was 10.71 wt. %, and the content of coarse particles with a particle diameter of 12.7 μm or more was 4.30 wt. %.

EXAMPLE 9

A toner for developing a latent electrostatic image to a visible toner image for use in electrophotographic image formation apparatus was produced by a method of producing toner, including the step of classifying a pulverized solid material by use of the above-mentioned classifier of the present invention.

As a result, a toner with a minimum classification error and a sharp particle distribution was obtained efficiently.

Japanese patent application no. 2000-050646 filed Feb. 28, 2000 is hereby incorporated by reference.

What is claimed is:

1. A classifier comprising:

a dispersion chamber for dispersing a powder material therein which is fed thereinto together with a stream of transportation gas through at least one feed inlet so as to cause a cyclonic flow of said powder material within said dispersion chamber, with finely-divided particles with particle diameters less than a predetermined particle diameter contained in said powder material being separated and discharged therefrom by means of centripetal force, a classification chamber connected to said dispersion chamber so that said powder material free of said finely-divided particles is fed thereinto from said dispersion chamber, which classification chamber serves to classify said powder material free of said finely-divided particles into fine particles and coarse particles by means of centrifugal force, and a conical member disposed between said dispersion chamber and said classification chamber, which serves as a partition therebetween and enhances the cyclonic flow of said powder material within said dispersion chamber, wherein said dispersion chamber comprises particle residence prevention means for preventing said powder material from residing within said dispersion chamber by changing the speed of the cyclonic flow of said powder material in said dispersion chamber so as to be decreased in the direction of said feed inlet within said dispersion chamber.

2. The classifier as claimed in claim 1, wherein said particle residence prevention means comprises a cylindrical chamber which constitutes an upper part of said dispersion chamber, with the upper base portion of said cylindrical chamber being made smaller in size than the lower base portion thereof, and said feed inlet being disposed at the smaller upper base portion of said chamber.

3. The classifier as claimed in claim 2, wherein said cylindrical chamber of said particle residence prevention means is in the shape of a circular truncated cone having such a side wall that is inclined at an angle of $\alpha$ with respect to a horizontal direction of said base portion of said chamber, where $0° < \alpha < 90°$.

4. The classifier as claimed in claim 2, wherein said cylindrical chamber of said particle residence prevention means has a curved side wall.

5. The classifier as claimed in claim 3, wherein said angle is in a range of $30° \leqq \alpha < 90°$.

6. The classifier as claimed in claim 1, wherein said particle residence prevention means is detachable from said dispersion chamber.

7. The classifier as claimed in claim 1, wherein said powder material is fed into said dispersion chamber through a plurality of feed inlets.

8. The classifier as claimed in claim 1, wherein said conical member further comprises at least one ring-shaped member with a predetermined diameter and a predetermined thickness at a lower portion of said conical member.

9. The classifier as claimed in claim 8, wherein at least one of said diameter or said thickness of said ring-shaped member is changeable.

10. The classifier as claimed in claim 8, wherein said ring-shaped member is detachable from said conical member.

11. A method of producing toner for developing a latent electrostatic image to a visible toner image for use in electrophotographic image formation apparatus, wherein a toner with a predetermined particle diameter range is produced, including classifying a pulverized solid material by use of a classifier, said method comprising:

feeding a powder material together with a stream of transportation gas through at least one feed inlet into a dispersion chamber for dispersing said powder material therein so as to cause a cyclonic flow of said powder material within said dispersion chamber, with finely-divided particles with particle diameters less than a predetermined particle diameter contained in said powder material being separated and discharged therefrom by means of centripetal force, and feeding said powder material free of said finely-divided particles from said dispersion chamber into a classification chamber connected to said dispersion chamber, which classification chamber serves to classify said powder material free of said finely-divided particles into fine particles and coarse particles by means of centrifugal force, wherein a conical member disposed between said dispersion chamber and said classification chamber serves as a partition therebetween and enhances the cyclonic flow of said powder material within said dispersion chamber, and wherein said dispersion chamber comprises particle residence prevention means for preventing said powder material from residing within said dispersion chamber by changing the speed of the cyclonic flow of said powder material in said dispersion chamber so as to be decreased in the direction of said feed inlet within said dispersion chamber.

12. The method of producing toner as claimed in claim 11, wherein said particle residence prevention means comprises a cylindrical chamber which constitutes an upper part of said dispersion chamber, with the upper base portion of said cylindrical chamber being made smaller in size than the lower base portion thereof, and said feed inlet being disposed at the smaller upper base portion of said chamber.

13. The method of producing toner as claimed in claim 12, wherein said cylindrical chamber of said particle residence prevention means is in the shape of a circular truncated cone having such a side wall that is inclined at an angle of $\alpha$ with respect to a horizontal direction of said base portion of said chamber, where $0° < \alpha < 90°$.

14. The method of producing toner as claimed in claim 12, wherein said cylindrical chamber of said particle residence prevention means has a curved side wall.

15. The method of producing toner as claimed in claim 13, wherein said angle is in a range of $30° \leqq \alpha < 90°$.

16. The method of producing toner as claimed in claim 11, wherein said particle residence prevention means is detachable from said dispersion chamber.

17. The method of producing toner as claimed in claim 11, wherein said powder material is fed into said dispersion chamber through a plurality of feed inlets.

18. The method of producing toner as claimed in claim 11, wherein said conical member further comprises at least one ring-shaped member with a predetermined diameter and a predetermined thickness at a lower portion of said conical member.

19. The method of producing toner as claimed in claim 18, wherein at least one of said diameter or said thickness of said ring-shaped member is changeable.

20. The method of producing toner as claimed in claim 18, wherein said ring-shaped member is detachable from said conical member.

* * * * *